United States Patent [19]

Hsu

[11] Patent Number: 4,802,789

[45] Date of Patent: Feb. 7, 1989

[54] COMBINED PUNCH AND CLIP

[76] Inventor: Walter W. Hsu, No. 156, Chen Pei Village, Chen Pei Road, Tou Liu City, Yun Lin Hsien, Taiwan

[21] Appl. No.: 192,911

[22] Filed: May 12, 1988

[51] Int. Cl.[4] ..... B42F 3/04

[52] U.S. Cl. ..... 402/1; 402/34

[58] Field of Search ..... 83/375, 453, 618; 7/158, 160; 402/31, 32, 34, 38, 1

[56] References Cited

U.S. PATENT DOCUMENTS

| | | | |
|---|---|---|---|
| 435,412 | 9/1890 | Fish | 402/34 X |
| 448,149 | 3/1891 | Henson | 402/34 X |
| 471,087 | 3/1892 | Ahrens et al. | 402/34 X |
| 926,261 | 6/1909 | Krag | 83/618 X |
| 1,152,886 | 9/1915 | Dom | 83/618 X |
| 1,154,294 | 9/1915 | Dom | 83/618 X |
| 4,466,322 | 8/1984 | Mori | 83/640 |

*Primary Examiner*—Frank T. Yost
*Assistant Examiner*—Rinaldi Rada

[57] ABSTRACT

A combined punch and clip has a base, a pair of punching elements, a pair of locking apparatuses, and a clipping shank. The base has a rectangular, flat and hollow shape; the punching elements and the locking apparatuses are symmetrically provided on the left and right sides of the base. The former are employed to punch two holes on a stack of paper to be collected, and the latter are employed to adjust the state of this invention either in a punching or in a storing state. The clipping shank is employed to secure the punched paper.

3 Claims, 5 Drawing Sheets

COMBINED PUNCH AND CLIP

BACKGROUND OF THE INVENTION

This invention relates to a combined punch and clip, and more particularly relates to such a combined punch and clip which can punch a pile of paper and then clip them together thereon.

Various types of punches and clips have been developed separately in many parts of the world, but no combined device incorporating both a punch and a clip has been disclosed. There are many ways to collect a stack of paper together; for example, a spring-loaded clip can be used to clamp papers together, or a file holder can be used to keep papers together by the binding of punched papers. The former is not usable if the load of papers is beyond the extent of the spring force; and the latter is subject to the separate steps of punching and binding papers. Accordingly, neither method is ideal in actual use.

The present invention has arisen from work in seeking to obviate and/or mitigate the above-mentioned drawbacks.

SUMMARY OF THE INVENTION

A primary objective of the present invention is to provide a combined punch and clip which can punch papers and then clip them together thereon.

Another objective of the present invention is to provide a combined punch and clip which is easily manufactured.

Still another objective of the present invention is to provide a combined punch and clip which has performance characteristics superior to any heretofore available.

Further objectives and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

Figure 1:
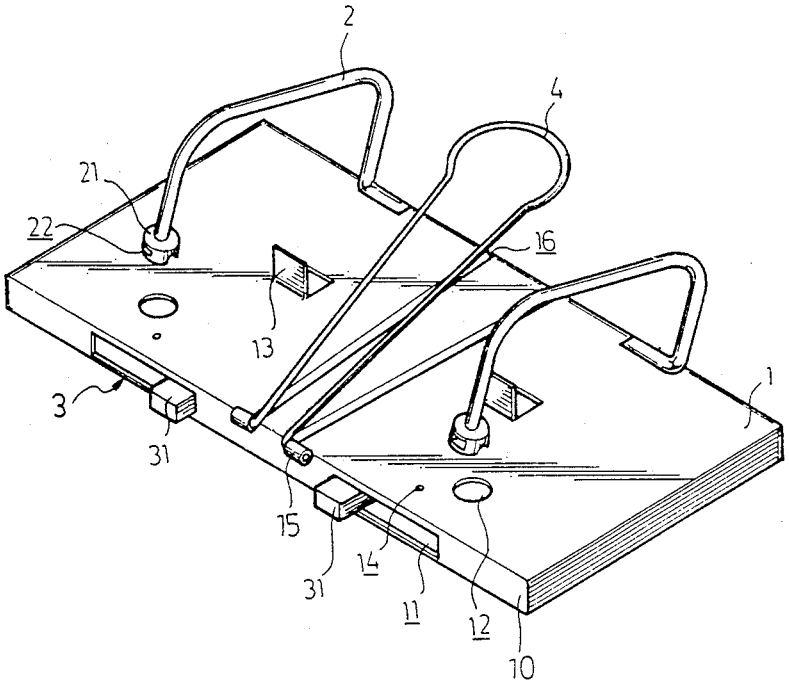
FIG. 1 is a perspective view of a combined punch and clip in accordance with the present invention.
Figure 2:
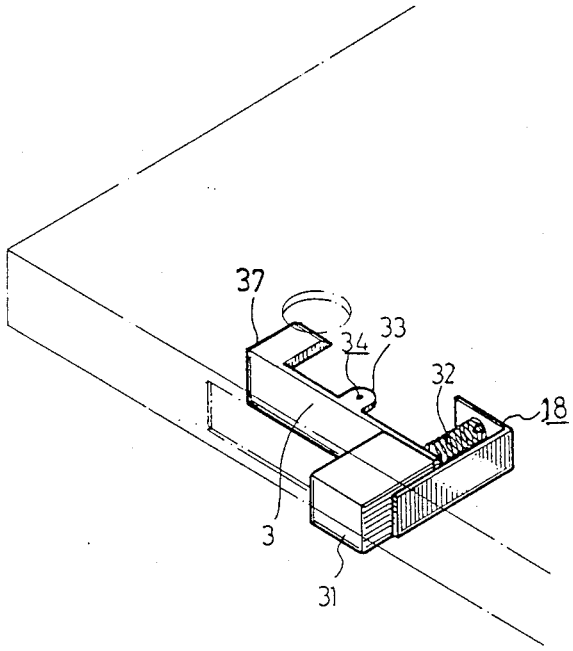
FIG. 2 is an enlarged view of one of the locking apparatuses of FIG. 1.

With reference to the drawings and particularly to FIGS. 1 and 2 thereof, it can be seen that a combined punch and clip in accordance with the present invention comprises a base 1, a pair of punching elements 2, a pair of locking apparatuses 3, and a clipping shank 4. The main purpose of the combined punch and clip is to be able to punch a stack of paper therewith and then clip the stack of paper thereon.

As can be seen in FIG. 1, the base 1 has a generally rectangular, flat ahd hollow shape; the punching elements 2 and the locking apparatuses 3 are symmetrically provided on the left and right sides of the base 1, wherein the former are employed to punch two holes on a stack of paper to be collected, and the latter are employed to adjust the state of this invention either in a punching state or in a storing state.

According to the above-mentioned description, it is appreciated that the other components of this application are also symmetrically provided on the base 1, except the clipping shank 4 which is employed to secure the punched paper.

A horizontal slot 11 is provided on a lateral surface 10 of the left and right sides of the base 1 for permitting one of the locking apparatus 3 to protrude therefrom. An opening 12 is provided on the left and right sides of the base 1, proximate to the horizontal slot 11, for permitting a respective punching element 2 to be insertable therein.

A punching element 2 is mounted, preferably soldered, at its distal end on the left and right sides of the base 1. A punching head 21 is provided on the other distal end of each punching element 2 proximate to the opening 12. Moreover, an aperture 22 is disposed on the lateral surface of the punching head 21 and is faced towards the horizontal slot 11 such that the locking element 3 can be wedged in the aperture 22 when the punching head 21 inserts into opening 12. The body of punching element 22 is curved so as to facilitate the forcing of the punching head 21 into opening 12.

A cutout 13 is integrally formed on the left and right sides of the base 1 at a position such that the distance between the cutout 13 and opening 12 is equal to the distance between the cutout 13 and the soldered distal end of the punching element 2. The cutouts 13 are used to align the stack of paper to be punched and clipped. A first hole 14 is disposed on the base 1, adjacent to the horizontal slot 11, for receiving a pin 30 to secure the locking apparatus 3.

Figure 3:
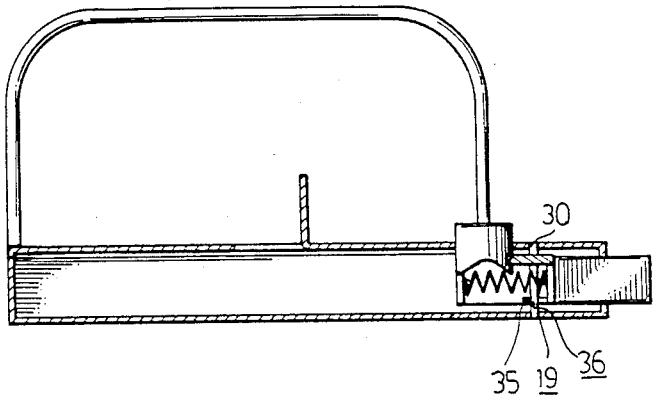
FIG. 3 is a cross-sectional view illustrating one of the punching element and locking apparatus of FIG. 1 in locked state.

Referring to FIGS. 2 and 3, it can be seen that the locking apparatuses 3 are respectively housed in the left and right sides of the base 1 and an L-shaped retarding means 18 mounted on the base 1 is adjacent to each locking apparatus 3. Protrusions 33, 35, having respective second and third holes 34, 36 thereon, are integrally formed on the upper and lower central horizontal portion of the locking apparatus 3 and are parallel with the base 1. Moreover, a fourth hole 19 is provided at the lower surface of the base 1 and is in alignment with the first, second and third holes such that the pin 30 is received by each of the above-mentioned holes to engage the base 1 and locking apparatus 3 together. Therefore, the locking apparatus 3 can be driven pivotally within the base 1.

The locking apparatus 3 comprises a controlling element 31 on a distal end thereof which horizontally protrudes from the horizontal slot 11 and is retractable because a spring 32 is disposed between the controlling element 31 and retarding means 18. Moreover, a retaining element 37 with a slanted surface is integrally formed on the other distal end of the locking apparatus 3. The retaining element 37 extends in a reverse direction from that of the spring-loaded controlling element 31 and is retractable in the aperture 22 of the punching head 21 to lock the punching element 2 while the punching head 21 is forced into the opening 12.

As to the assembly of the shank 4, shown in FIG. 1, a pair of cylindrical components 15 are mounted on the upper central horizontal portion of the lateral surface 10 of the base 1 to receive both distal ends of the clipping shank 4. Further, a groove 16 is formed according to the shape of the clipping shank 4 on the base 1 in order to flushly receive the clipping shank 4 when the clipping shank 4 is adjacent to the base 1.

Figure 4:
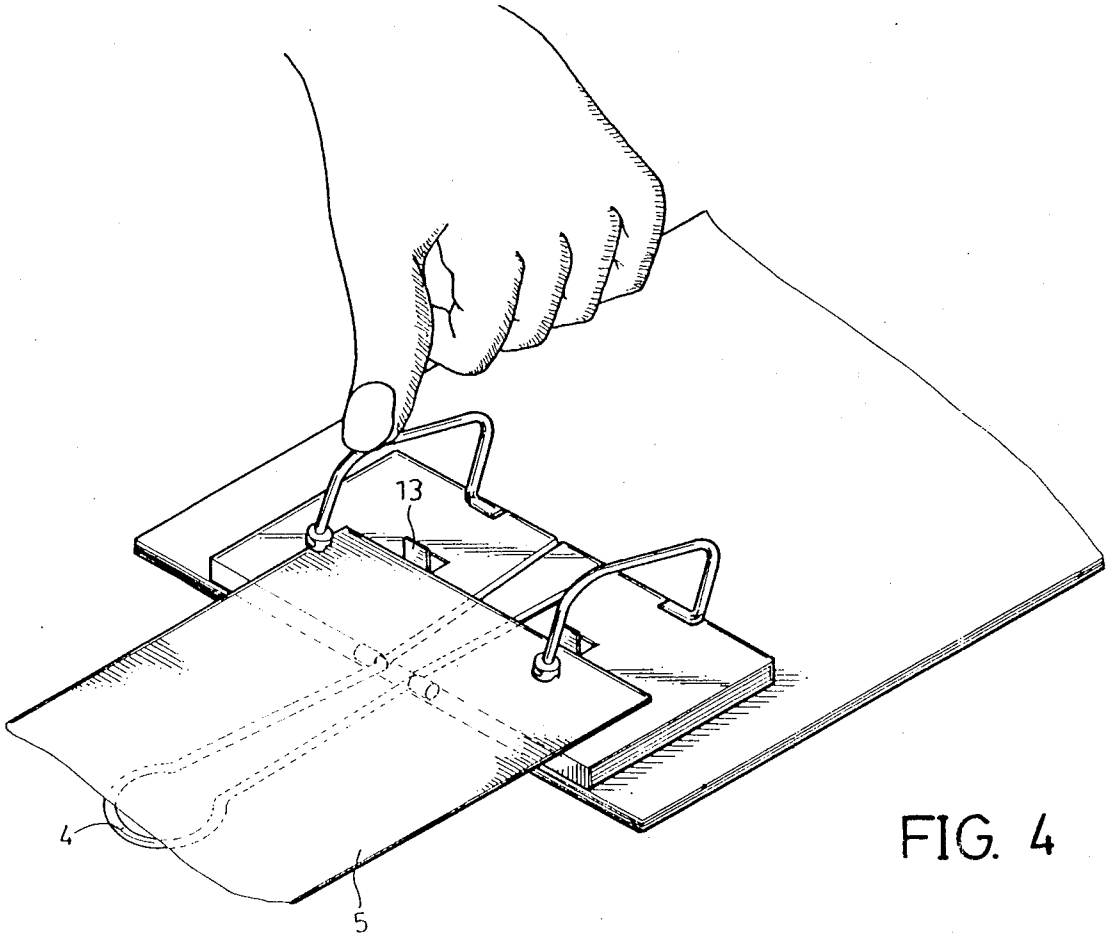
FIG. 4 is a working view of the combined punch and clip of FIG. 1 wherein the user is going to punch papers.
Figure 5:
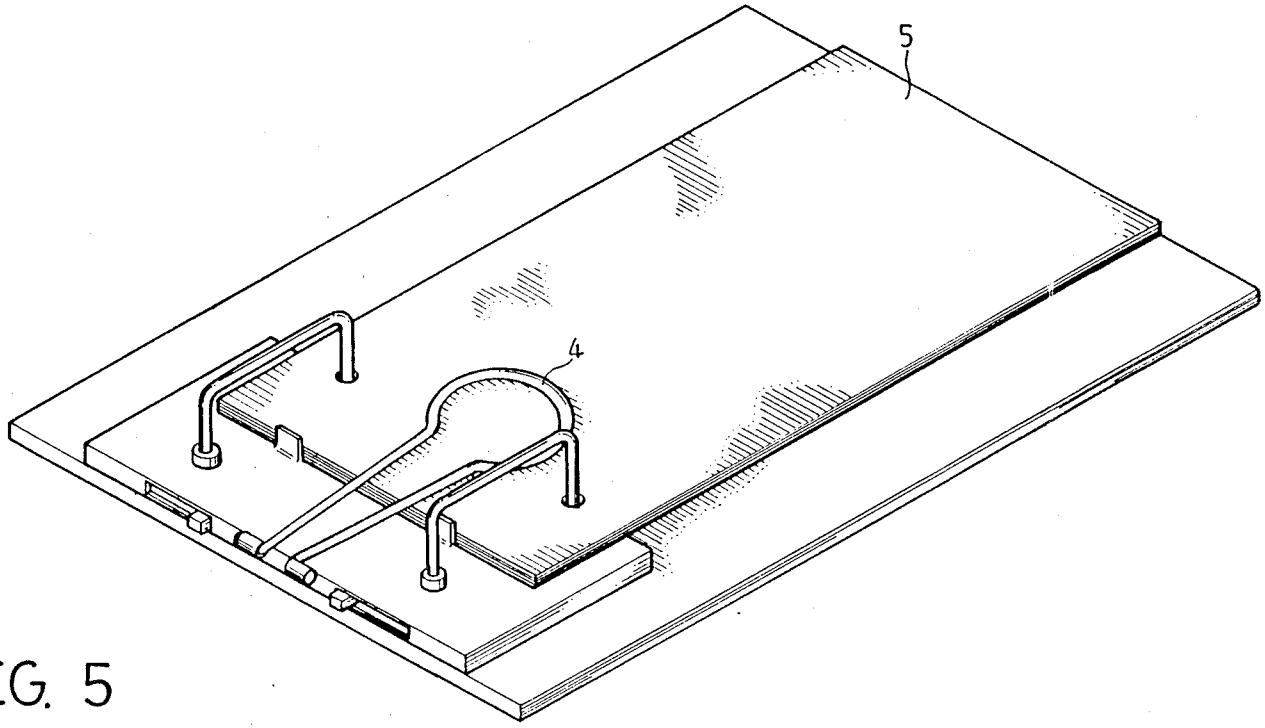
FIG. 5 is a sequential view of the combined punch and clip of FIG. 4 illustrating how the papers are kept together after being punched.

With particular reference to FIG. 4, it can be seen that a piece of paper 5, which is against the cutout 13, is about to be punched. Simultaneously, the clipping shank 4 (shown in dotted lines) is in fully open position, and the clipping shank 4 attaches the paper 5 to this invention after the paper 5 is punched and then turned to the other side of the punching element 2 for retention purposes, as shown in FIG. 5.

While the invention has been explained in relation to its preferred embodiments it is to be understood that various modifications thereof will become apparent to those skilled in the art upon reading this specification. Therefore, it is to be understood that the invention disclosed herein is intended to cover such modifications as fall within the scope of the appended claims.

I claim:

1. A combined punch and clip for punching a stack of paper therewith and clipping said stack of paper together thereon, comprising a base (1), two punching elements (2), two locking apparatuses (3), and a clipping shank (4), wherein:

said base (1) comprises respective horizontal slots (11) provided on left and right sides of a lateral surface (10) of said base for permitting respective said locking apparatuses (3) to protrude therefrom; respective openings (12) are provided proximate to each of said horizontal slots (11); a pair of cylindrical components (15) are mounted on an upper central horizontal portion of said lateral surface (10) of said base (1) for receiving distal ends of said clipping shank (4);

said respective punching elements (2) are mounted at distal ends thereof on left and right sides of said base (1); a punching head (21) is provided on another distal end of each of said punching elements (2) proximate to and insertable in said opening (12); an aperture (22) is disposed at a lateral surface of said punching head (21) and facing said horizontal slot (11) to permit said locking element (3) to be wedged therebetween; and said respective locking apparatuses (3) are housed in left and right sides of said base (1) and pivotally fixed therein by respective pins (30); respective retarding means (18) mounted on left and right sides of said base (1) are adjacent to each said locking apparatus (3); a spring-loaded controlling element (31) is provided on each of said locking apparatuses (3) and protrudes from said horizontal slot (11) with a spring (32) disposed between said controlling element (31) and said retarding means (18); and a retaining element (37) formed on said locking apparatus (3) is retractable in said aperture (22) of said punching head (21) to lock said punching element (2).

2. A combined punch and clip as set forth in claim 1, wherein respective cutouts (13) are integrally formed on left and right sides of the base 1 for aligning said stack of paper.

3. A combined punch and clip as set forth in claim 1, wherein a groove (16) is formed according to a shape of said clipping shank (4) on said base (1) for flushly receiving said clipping shank (4).

* * * * *